US008795108B2

(12) United States Patent
Chauvin et al.

(10) Patent No.: US 8,795,108 B2
(45) **Date of Patent: *Aug. 5, 2014**

(54) BALL BAT WITH GOVERNED PERFORMANCE

(71) Applicant: Easton Sports, Inc., Van Nuys, CA (US)

(72) Inventors: Dewey Chauvin, Simi Valley, CA (US); William B. Giannetti, Winnetka, CA (US); Hsing-Yen Chuang, Simi Valley, CA (US); Ian Montgomery, Simi Valley, CA (US)

(73) Assignee: Easton Baseball/Softball Inc., Van Nuys, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/917,438

(22) Filed: Jun. 13, 2013

(65) Prior Publication Data

US 2013/0274039 A1 Oct. 17, 2013

Related U.S. Application Data

(63) Continuation of application No. 13/652,332, filed on Oct. 15, 2012, now Pat. No. 8,480,519, which is a continuation of application No. 12/343,323, filed on Dec. 23, 2008, now Pat. No. 8,298,102.

(51) Int. Cl.
*A63B 59/06* (2006.01)

(52) U.S. Cl.
USPC ..... 473/566; 473/567

(58) Field of Classification Search
USPC ..... 473/457, 519, 520, 564–568
See application file for complete search history.

(56) References Cited

U.S. PATENT DOCUMENTS

| | | | | | |
|---|---|---|---|---|---|
| 2,099,521 | A | * | 11/1937 | Herkimer et al. | 473/568 |
| 3,703,290 | A | * | 11/1972 | Wilson | 473/520 |
| 3,727,295 | A | * | 4/1973 | Gildemeister | 29/455.1 |
| 3,729,196 | A | * | 4/1973 | Heald, Jr. | 473/520 |
| 3,801,098 | A | * | 4/1974 | Gildemeister | 473/520 |
| 3,830,496 | A | * | 8/1974 | Reizer | 473/567 |
| 3,861,682 | A | * | 1/1975 | Fujii | 473/520 |
| 3,876,204 | A | * | 4/1975 | Moore et al. | 473/520 |
| 3,877,698 | A | * | 4/1975 | Volpe | 473/520 |
| 3,880,423 | A | * | 4/1975 | Kreag | 473/566 |
| 3,921,978 | A | * | 11/1975 | Warren | 473/567 |
| 3,963,239 | A | * | 6/1976 | Fujii | 473/519 |
| 4,014,542 | A | * | 3/1977 | Tanikawa | 473/567 |
| 4,032,143 | A | * | 6/1977 | Mueller et al. | 473/567 |
| 4,056,267 | A | * | 11/1977 | Krieger | 473/520 |
| 4,079,936 | A | * | 3/1978 | Schachter | 463/47.2 |
| 4,343,467 | A | * | 8/1982 | Newcomb et al. | 473/567 |
| 4,348,247 | A | * | 9/1982 | Loyd et al. | 156/156 |
| 4,543,284 | A | * | 9/1985 | Baum | 428/106 |
| 4,600,193 | A | * | 7/1986 | Merritt | 473/566 |
| 4,746,117 | A | * | 5/1988 | Noble et al. | 473/566 |
| 5,094,453 | A | * | 3/1992 | Douglas et al. | 473/566 |
| 5,104,123 | A | * | 4/1992 | Okitsu et al. | 473/520 |
| 5,180,163 | A | * | 1/1993 | Lanctot et al. | 473/520 |
| 5,364,095 | A | * | 11/1994 | Easton et al. | 473/566 |

(Continued)

*Primary Examiner* — Mark Graham
(74) *Attorney, Agent, or Firm* — Perkins Coie LLP

(57) ABSTRACT

A ball bat includes a barrel in which one or more stiffening elements or damping elements, or both, are located. The stiffening or damping elements may be positioned at a variety of locations, and may have a variety of configurations, for selectively reducing the barrel's performance without appreciably increasing the bat's moment of inertia.

18 Claims, 9 Drawing Sheets

(56) References Cited

U.S. PATENT DOCUMENTS

| | | | | | |
|---|---|---|---|---|---|
| 5,393,055 | A * | 2/1995 | McKay, Jr. | 473/566 |
| 5,395,108 | A * | 3/1995 | Souders et al. | 473/567 |
| 5,458,330 | A * | 10/1995 | Baum | 473/567 |
| 5,533,723 | A * | 7/1996 | Baum | 156/245 |
| 5,575,722 | A * | 11/1996 | Saia et al. | 473/300 |
| 5,624,115 | A * | 4/1997 | Baum | 473/567 |
| 5,759,113 | A * | 6/1998 | Lai et al. | 473/321 |
| 5,964,673 | A * | 10/1999 | MacKay, Jr. | 473/566 |
| 6,042,485 | A * | 3/2000 | Cheng | 473/318 |
| 6,042,493 | A * | 3/2000 | Chauvin et al. | 473/566 |
| 6,077,178 | A * | 6/2000 | Brandt | 473/520 |
| 6,152,840 | A * | 11/2000 | Baum | 473/564 |
| 6,334,824 | B1 * | 1/2002 | Filice et al. | 473/566 |
| 6,398,675 | B1 * | 6/2002 | Eggiman et al. | 473/566 |
| 6,497,631 | B1 * | 12/2002 | Fritzke et al. | 473/566 |
| 6,612,945 | B1 * | 9/2003 | Anderson | 473/566 |
| 6,729,983 | B1 * | 5/2004 | Vakili et al. | 473/566 |
| 6,755,757 | B2 * | 6/2004 | Sutherland | 473/566 |
| 6,869,372 | B1 * | 3/2005 | Higginbotham et al. | 473/566 |
| 6,872,156 | B2 * | 3/2005 | Ogawa et al. | 473/567 |
| 6,949,038 | B2 * | 9/2005 | Fritzke | 473/566 |
| 6,994,641 | B2 * | 2/2006 | Hebreo et al. | 473/520 |
| 7,011,588 | B2 * | 3/2006 | Fritzke et al. | 473/567 |
| 7,115,054 | B2 * | 10/2006 | Giannetti et al. | 473/567 |
| 8,298,102 | B2 * | 10/2012 | Chauvin et al. | 473/566 |
| 2002/0151392 | A1 * | 10/2002 | Buiatti et al. | 473/566 |
| 2005/0070384 | A1 * | 3/2005 | Fitzgerald et al. | 473/567 |
| 2006/0025253 | A1 * | 2/2006 | Giannetti et al. | 473/567 |
| 2009/0143176 | A1 * | 6/2009 | Burger | 473/564 |

* cited by examiner

BEFORE IMPACT

AFTER IMPACT

BEFORE IMPACT

AFTER IMPACT

BALL BAT WITH GOVERNED PERFORMANCE

CROSS REFERENCE TO RELATED APPLICATIONS

This application is a continuation of U.S. patent application Ser. No. 13/652,332, filed Oct. 15, 2012, and now pending, which is a continuation of U.S. patent application Ser. No. 12/343,323, filed Dec. 23, 2008, now U.S. Pat. No. 8,298,102, both of which are incorporated herein by reference.

BACKGROUND

Baseball and softball governing bodies have imposed various bat performance limits over the years with the goal of regulating batted ball speeds. Each association generally independently develops various standards and methods to achieve a desired level of play. Bat designers typically comply with these performance standards by adjusting the performance, or bat-ball coefficient of restitution ("BBCOR"), of their bat barrels. Typical methods of controlling BBCOR include thickening the barrel wall of a hollow metal bat, or increasing the radial stiffness of a composite bat via the selection of specific materials and fiber angles. A composite bat's radial stiffness and fiber orientations are limited, however, by a given material thickness. The barrel walls in composite bats, therefore, are also often thickened to provide additional stiffness, which in turn limits BBCOR and barrel performance.

Thickening a barrel wall generally increases the bat's weight and, more importantly, it's "swing weight" or moment of inertia ("MOI"). MOI is the product of: (a) a mass, and (b) the square of the distance between the center of the mass and the point from which the mass is pivoted. Mathematically, this is expressed as follows:

$$MOI=\Sigma Mass\times(Distance)^2$$

Accordingly, the MOI dictates that it becomes increasingly difficult to swing a bat as the bat's mass increases or as the center of the bat's mass moves farther from the pivot point of the swing (i.e., farther from the batter's hands). Because thickening the barrel wall increases the bat's weight at a region relatively distal from the batter's hands, doing so also increases the bat's MOI. Thus, while thickening a barrel wall effectively stiffens the barrel and reduces its performance, the consequent increase in MOI is generally undesirable for batters.

SUMMARY

A ball bat includes a barrel in which one or more stiffening elements or damping elements, or both, are located. The stiffening or damping elements may be positioned at a variety of locations, and may have a variety of configurations, for selectively limiting the barrel's performance without appreciably increasing the bat's moment of inertia.

Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the several views.

DETAILED DESCRIPTION OF THE DRAWINGS

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list.

The embodiments described herein are directed to a ball bat having a limited bat-ball coefficient of restitution ("BBCOR"), or limited barrel performance, allowing the bat to perform within regulatory association performance limits. The National Collegiate Athletic Association ("NCAA"), for example, has proposed limiting a barrel's BBCOR to below 0.510 or below 0.500. Limiting of the BBCOR is preferably accomplished without appreciably increasing (or by decreasing) the ball bat's moment of inertia ("MOI").

Figure 1:
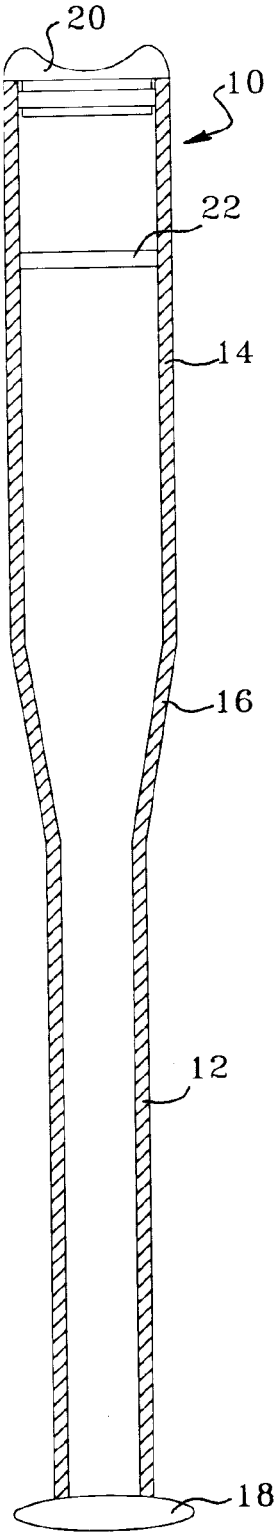
FIG. 1 is a side-sectional view of a ball bat including a stiffening element, according to one embodiment.

Turning now in detail to the drawings, as shown in FIG. 1, a baseball or softball bat 10, hereinafter collectively referred to as a "ball bat" or "bat," includes a handle 12, a barrel 14, and a tapered section 16 joining the handle 12 to the barrel 14. The free end of the handle 12 includes a knob 18 or similar structure. The barrel 14 is preferably closed off by a suitable cap 20 or plug. The interior of the bat 10 is optionally hollow, allowing the bat 10 to be relatively lightweight so that ball players may generate substantial bat speed when swinging the bat 10. The ball bat 10 may be a one-piece construction or may include two or more separate attached pieces (e.g., a separate handle and barrel), as described, for example, in U.S. Pat. No. 5,593,158, which is incorporated herein by reference.

The ball bat 10 is preferably constructed from one or more composite or metallic materials. Some examples of suitable composite materials include fiber-reinforced glass, graphite, boron, carbon, aramid, ceramic, Kevlar, or Astroquartz®. Aluminum or another suitable metallic material may also be used to construct the ball bat 10. A ball bat including a combination of metallic and composite materials may also be constructed. For example, a ball bat having a metal barrel and a composite handle, or a composite barrel and a metal handle, may be used in the embodiments described herein.

The bat barrel 14 may include a single-wall or multi-wall construction. A multi-wall barrel may include, for example, barrel walls that are separated from one another by one or more interface shear control zones ("ISCZs"), as described in detail in U.S. Pat. No. 7,115,054, which is incorporated herein by reference. An ISCZ may include, for example, a disbonding layer or other element, mechanism, or space suitable for preventing transfer of shear stresses between neighboring barrel walls. A disbonding layer or other ISCZ preferably further prevents neighboring barrel walls from bonding to each other during curing of, and throughout the life of, the ball bat 10.

The ball bat 10 may have any suitable dimensions. The ball bat 10 may have an overall length of 20 to 40 inches, or 26 to 34 inches. The overall barrel diameter may be 2.0 to 3.0 inches, or 2.25 to 2.75 inches. Typical ball bats have diameters of 2.25, 2.625, or 2.75 inches. Bats having various combinations of these overall lengths and barrel diameters, or any other suitable dimensions, are contemplated herein. The specific preferred combination of bat dimensions is generally dictated by the user of the bat 10, and may vary greatly between users.

The ball striking area of the bat 10 typically extends throughout the length of the barrel 14, and may extend partially into the tapered section 16 of the bat 10. For ease of description, this striking area will generally be referred to as the "barrel" throughout the remainder of the description. A bat barrel 14 generally includes a maximum performance location or "sweet spot," which is the impact location where the transfer of energy from the bat 10 to a ball is maximal, while the transfer of energy to a player's hands is minimal. The sweet spot is generally located at the intersection of the bat's center of percussion (COP) and its first three fundamental nodes of vibration. This location, which is typically about 4 to 8 inches from the free end of the barrel 14, does not move when the bat is vibrating in its first (or fundamental) bending mode.

The barrel regions between the sweet spot and the free end of the barrel 14, and between the sweet spot and the tapered section 16 of the bat 10, do not provide the maximum performance that occurs at the sweet spot of the barrel 14. Indeed, in a typical ball bat, the barrel's performance, or trampoline effect, decreases as the impact location moves away from the sweet spot. Accordingly, the sweet spot generally requires the greatest limitation or reduction of BBCOR to bring the bat within regulatory association limits.

In one embodiment, a stiffening element 22 is positioned in the bat barrel 14, at or near the sweet spot of the barrel 14, to limit or reduce the BBCOR of the barrel 14. The stiffening element 22 may be co-molded with the inner surface of a composite bat barrel, or may be adhesively bonded, welded, or otherwise affixed to the inner surface of a composite or metallic bat barrel. In some embodiments, as further described below, the stiffening element 22 may optionally be spaced from, and affixed to, the inner surface of the bat barrel 14. While the stiffening element is generally identified with reference numeral "22" in FIG. 1, a variety of reference numerals will be used in the subsequent drawings to identify a variety of stiffening element configurations. In some embodiments, more than one stiffening element may be positioned in the bat barrel 14.

Any of the stiffening elements described herein, unless otherwise specified, may be made of any suitable stiffening materials. A stiffening element may be made of, for example, aluminum, titanium, or steel; composites of polyester, epoxy, or urethane resins with fibers of carbon, glass, boron, Spectra®, Kevlar®, Vectran®, and so forth, including sheet molding compound or bulk molding compound; or thermoplastics such as ABS, nylon, polycarbonate, acrylic, PVC, Delrin®, and so forth, with or without additive fibers, platelets, and particulates, such as nano-clay, nano-particulates, platelets, or short or long fibers of glass, carbon, and so forth.

Figure 21:
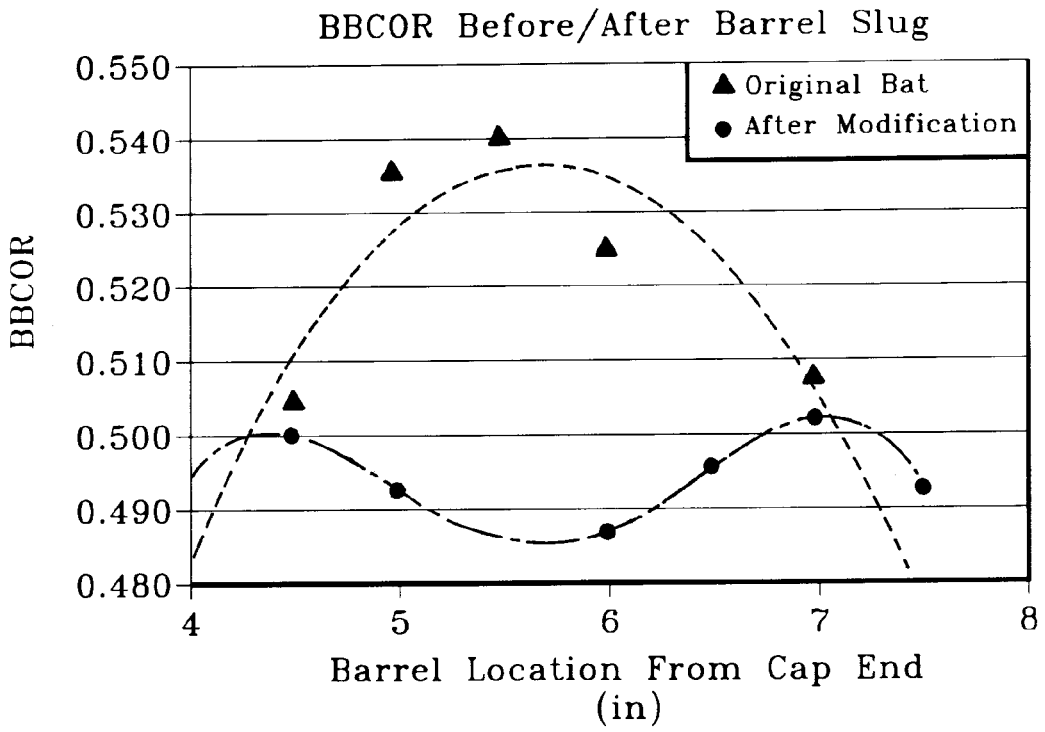
FIG. 21 is a graph comparing the BBCOR of a bat barrel before and after modification of the barrel with a stiffening element.

The inclusion of one or more discrete stiffening elements 22 in the barrel 14, as opposed to significantly thickening a substantial portion of the barrel 14, provides a significant reduction in BBCOR without a substantial increase in the bat's MOI. Surprisingly, inclusion of a single discrete stiffening element 22 can appreciably reduce BBCOR along a substantial length of the bat barrel 14. It has been found, for example, that affixing a 0.5-inch thick urethane disk or slug on the inside surface of the bat barrel 14, approximately 6 inches from the cap-end of the bat 10, can reduce the barrel's performance over approximately 1.5 inches in either direction from the stiffening element 22. FIG. 21 illustrates the effect affixing such a stiffening element 22 in the bat barrel 14 has on the barrel's BBCOR over the length of the barrel 14. As can be seen from the graph, the inclusion of a small urethane disk can have a relatively dramatic effect on the barrel's BBCOR.

Several examples of stiffening elements are shown in FIGS. 2-20. The specific type, size, and configuration of the one or more stiffening elements used in a given bat may be dictated by the performance limits of a given regulatory association, the weight and feel preferences of a given batter, and so forth. While it is generally preferred that the stiffening elements be positioned at or near the sweet spot of the barrel 14, it may be preferable in some embodiments to locate a stiffening element in other bat regions, such as closer to the handle 12 to limit the increase in MOI resulting from inclusion of the stiffening element. Thus, depending on the design goals for a particular bat, one or more of the following embodiments may be utilized at one or more locations of the ball bat 10.

Figure 2:
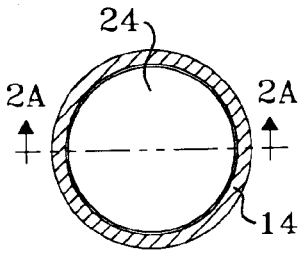
FIG. 2 is a top-sectional view of a bat barrel including a solid cylindrical stiffening element.
Figure 2A:
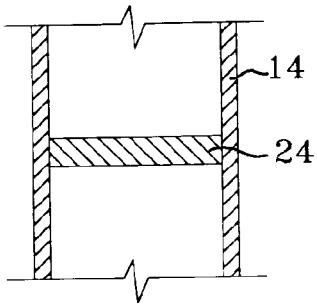
FIG. 2A is a side-sectional view of the barrel section shown in FIG. 2 taken along the section line in FIG. 2.

FIGS. 2 and 2A illustrate a solid cylindrical stiffening element 24 affixed to the bat barrel 14 along the inner diameter of the barrel 14. The cylindrical stiffening element 24 may, for example, be a 0.5-inch thick urethane disk or slug adhered to the inner surface of the barrel 14. The urethane slug may be self-adhering or may be adhered to the inner surface of the barrel 14 with an epoxy or other suitable adhering substance. Any other suitable size slug, of any other suitable material, may alternatively be affixed to the inner surface of the barrel 14.

Figure 3:
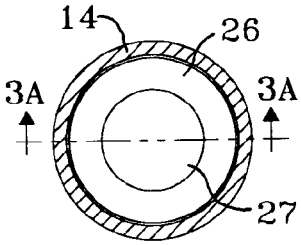
FIG. 3 is a top-sectional view of a bat barrel including a solid cylindrical stiffening element having a variable thickness.
Figure 3A:
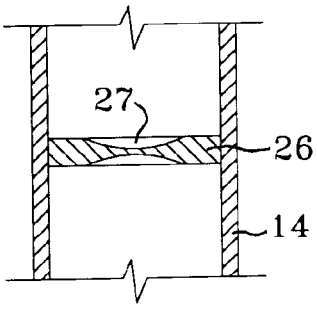
FIG. 3A is a side-sectional view of the barrel section shown in FIG. 3 taken along the section line in FIG. 3.

FIGS. 3 and 3A illustrate a solid cylindrical stiffening element 26, having a varying axial thickness, affixed to the inner surface of the bat barrel 14 along the inner diameter of the barrel 14. Reducing the thickness of portions 27 of the stiffening element 26 reduces its overall weight, which therefore reduces the bat's MOI relative to a bat including a similar stiffening element of uniform thickness.

Figure 4:
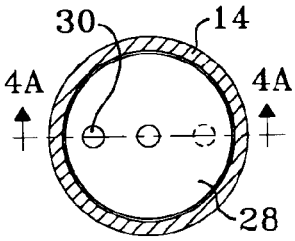
FIG. 4 is a top-sectional view of a bat barrel including a cylindrical stiffening element having multiple openings.
Figure 4A:
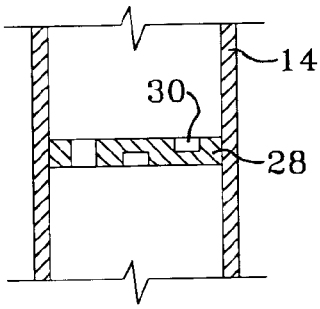
FIG. 4A is a side-sectional view of the barrel section shown in FIG. 4 taken along the section line in FIG. 4.
Figure 5:
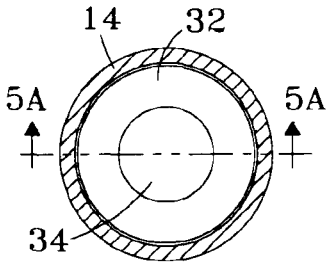
FIG. 5 is a top-sectional view of a bat barrel including a cylindrical stiffening element having a central opening.
Figure 5A:
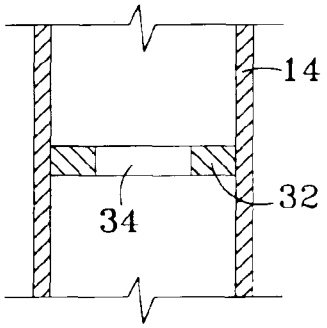
FIG. 5A is a side-sectional view of the barrel section shown in FIG. 5 taken along the section line in FIG. 5.

FIGS. 4 and 4A illustrate a cavitated cylindrical stiffening element 28 including multiple openings 30. One or more of the openings 30 may extend partially or entirely through the stiffening element 28. FIGS. 5 and 5A illustrate a stiffening element 32 including a central opening 34. Providing one or more openings in the stiffening element 28 reduces its overall weight, which therefore reduces the bat's MOI relative to a bat including a similar stiffening element without openings. Providing a relatively large central opening 34 increases the stresses in the stiffening element 32, since there is less support in the center of the stiffening element 32. Accordingly, the stiffening element 32 is preferably made of a durable material, such as a high strength tube of aluminum or composite fiber (e.g., fibers of carbon epoxy, glass epoxy, steel, nylon, Delrin®, etc.).

Figure 6:
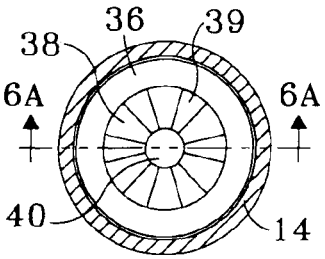
FIG. 6 is a top-sectional view of a bat barrel including a "spoked wheel" stiffening element.
Figure 6A:
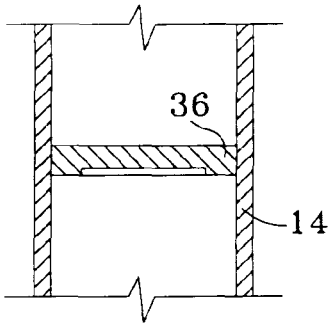
FIG. 6A is a side-sectional view of the barrel section shown in FIG. 6 taken along the section line in FIG. 6.
Figure 6B:
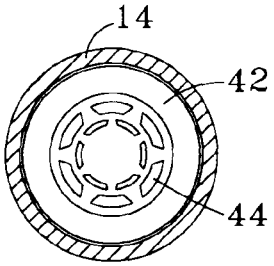
FIG. 6B is a top-sectional view of a bat barrel including a "slotted wheel" stiffening element.
Figure 6C:
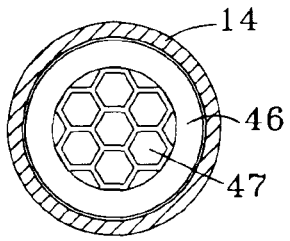
FIG. 6C is a top-sectional view of a bat barrel including a honeycomb stiffening element.

FIGS. 6 and 6A illustrate a cylindrical stiffening element 36 including slots 38, legs 39, and a central hub 40. FIG. 6B illustrates an alternative stiffening element 42 including layers of slots 44. FIG. 6C illustrates another alternative stiffening element 46 including a honeycomb design providing several openings 47. Such a "spoked wheel," slotted, or honeycomb design provides relatively high stiffness and minimal weight, and thus a relatively substantial decrease in BBCOR and a relatively minimal increase in the bat's MOI. The thickness of any of these stiffening elements may optionally be varied, as well. As the amount of material in any of these stiffening elements is reduced, a higher modulus, higher strength material is preferably selected to provide required durability to the stiffening element.

Figure 7:
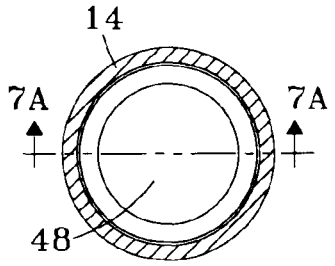
FIG. 7 is a top-sectional view of a bat barrel including a stiffening element with reinforced edges.
Figure 7A:
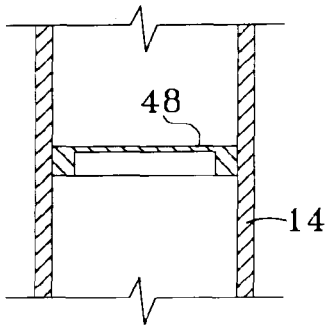
FIG. 7A is a side-sectional view of one embodiment of the barrel section shown in FIG. 7, including a cup-shaped stiffening element, taken along the section line in FIG. 7.
Figure 7B:
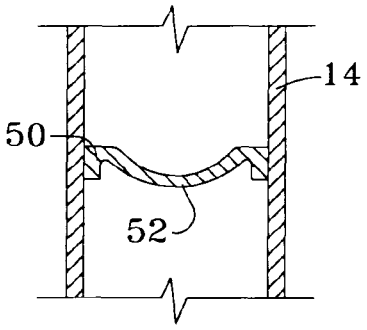
FIG. 7B is a side-sectional view of an alternate embodiment of the barrel section shown in FIG. 7, including a stiffening element having a non-linear central region, taken along the section line shown in FIG. 7.
Figure 7C:
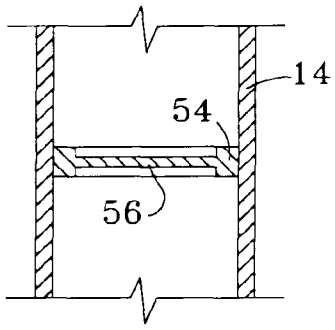
FIG. 7C is side-sectional view of another alternate embodiment of the barrel section shown in FIG. 7, including a stiffening element with material removed above and below a rigid central region, taken along the section line shown in FIG. 7.

FIGS. 7 and 7A illustrate a stiffening element 48 in the form of a rigid "cup." FIG. 7B illustrates an alternative stiffening element 50 including a non-linear central region 52. FIG. 7C illustrates an alternative stiffening element 54 with material removed above and below its rigid central region 56. These stiffening elements with material removed have a reduced overall weight, which therefore reduces the bat's MOI relative to a bat including a similar stiffening element with no material removed.

Figure 8:
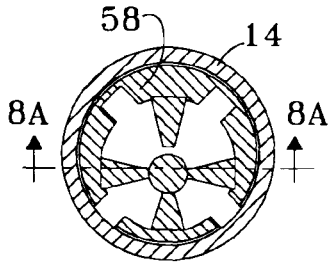
FIG. 8 is a top-sectional view of a bat barrel including a stiffening element that does not mate with the entire circumference of the inner surface of the barrel, according to one embodiment.
Figure 8A:
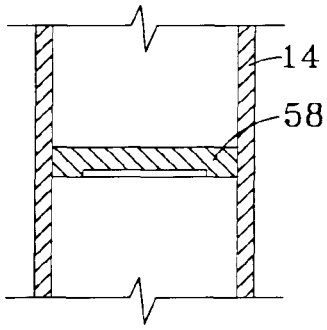
FIG. 8A is a side-sectional view of the barrel section shown in FIG. 8 taken along the section line in FIG. 8
Figure 9:
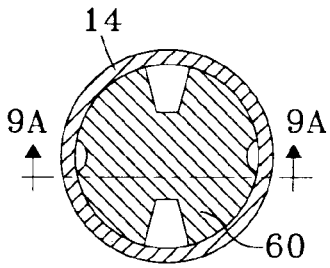
FIG. 9 is a top-sectional view of a bat barrel including a stiffening element that does not mate with the entire circumference of the inner surface of the barrel, according to another embodiment
Figure 9A:
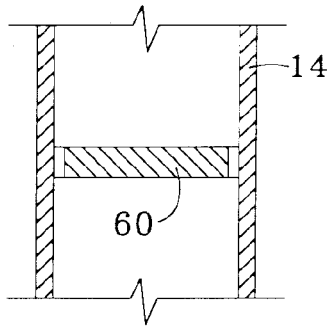
FIG. 9A is a side-sectional view of the barrel section shown in FIG. 9 taken along the section line in FIG. 9.

FIGS. 8 and 8A illustrate a stiffening element 58 that does not mate with the entire circumference of the inner surface of the barrel 14. FIGS. 9 and 9A illustrate an alternative configuration of a stiffening element 60 that does not mate with the entire circumference of the inner surface of the barrel 14. Such configurations have a lower weight than a similarly sized solid disk or slug, and are generally easier to install in the barrel 14 due to the relative flexibility provided by the removed material.

Figure 10:
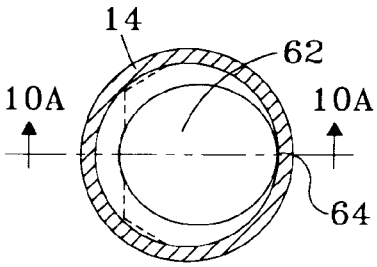
FIG. 10 is a top-sectional view of a bat barrel including a stiffening element attached to a single region of the inner surface of the bat barrel, according to one embodiment.
Figure 10A:
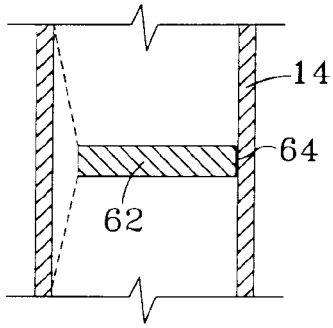
FIG. 10A is a side-sectional view of the barrel section shown in FIG. 10 taken along the section line in FIG. 10.
Figure 11:
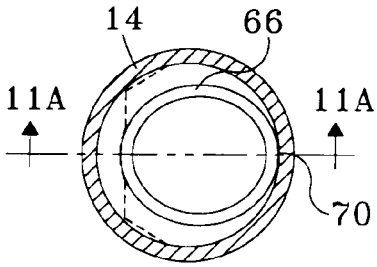
FIG. 11 is a top-sectional view of a bat barrel including a stiffening element attached to a single region of the inner surface of the barrel, according to another embodiment.
Figure 11A:
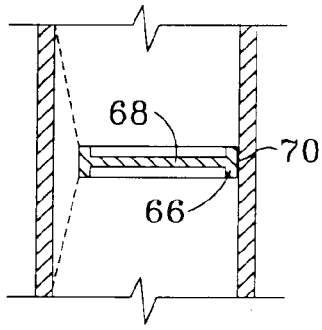
FIG. 11A is a side-sectional view of the barrel section shown in FIG. 11 taken along the section line in FIG. 11.

Any of the stiffening elements disclosed herein may optionally be attached to only a single region of the inner surface of the barrel 14 to provide limited barrel flexure or compliance. FIGS. 10 and 10A, for example, illustrate a solid cylindrical stiffening element 62 bonded or otherwise attached to a single region 64 of the barrel 14. FIGS. 11 and 11A illustrate an alternative stiffening element 66, with material removed above and below its rigid central region 68, bonded or otherwise attached to a single region 70 of the barrel 14. These configurations allow for limited movement of the barrel wall from its resting state upon contact with a ball, which is indicated by the dotted lines in the figures. Upon contact with a ball, the barrel flexes inwardly until it comes into contact with the rigid stiffening element, which acts as a backstop.

The amount of allowable barrel movement or flexure may be modified by adjusting the gap between the barrel and the stiffening element. Alternatively, the stiffening element may be spaced from, but connected to, the inner surface of the barrel 14 with a compliant adhesive, such as a compliant urethane. Accordingly, when contact with a ball occurs, the barrel wall flexes inwardly to compress or displace the compliant adhesive such that the barrel wall moves toward the stiffening element.

Figure 12:
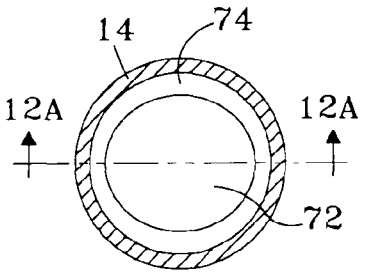
FIG. 12 is a top-sectional view of a bat barrel, before impact, including a stiffening element supported away from the inner surface of the barrel, according to one embodiment.
Figure 12A:
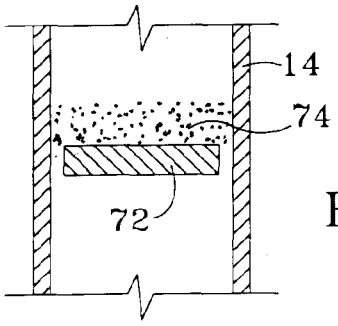
FIG. 12A is a side-sectional view of the barrel section shown in FIG. 12 taken along the section line in FIG. 12.
Figure 12B:
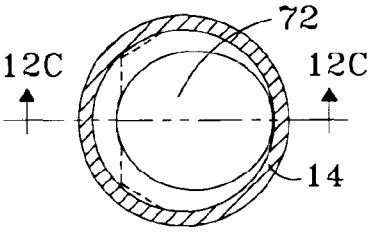
FIG. 12B is a top-sectional view of the bat barrel shown in FIG. 12, after impact.
Figure 12C:
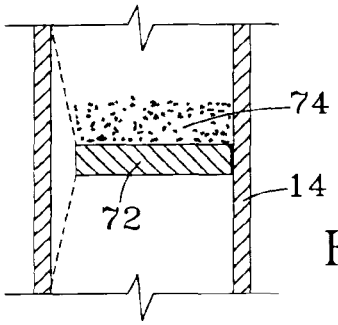
FIG. 12C is a side-sectional view of the barrel section shown in FIG. 12B taken along the section line in FIG. 12B.

FIGS. 12 and 12A illustrate a stiffening element 72 supported away from the inner surface of the barrel 14 in the bat's resting state. A lightweight material, such as a polyurethane foam block 74, for example, may be bonded to the inner surface of the barrel 14 while holding the stiffening element 72 in position. As shown in FIGS. 12B and 12C, upon impact with a ball, the barrel wall flexes inwardly until it contacts the stiffening element 72 and pushes it against the opposing barrel wall, which acts as a backstop.

Figure 13:
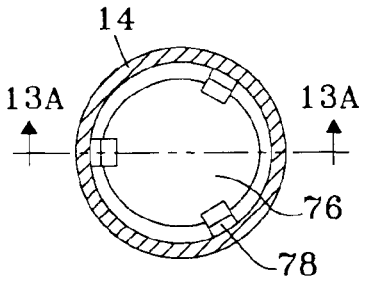
FIG. 13 is a top-sectional view of a bat barrel, before impact, including a stiffening element supported away from the inner surface of the barrel, according to an alternate embodiment.
Figure 13A:
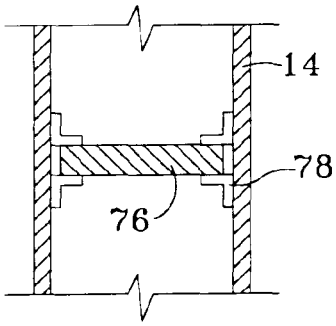
FIG. 13A is a side-sectional view of the barrel section shown in FIG. 13 taken along the section line in FIG. 13.
Figure 13B:
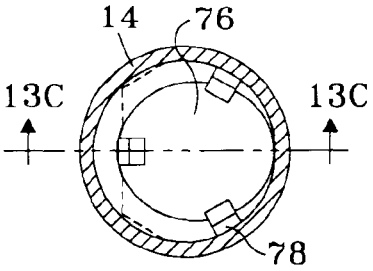
FIG. 13B is a top-sectional view of the bat barrel shown in FIG. 13, after impact.
Figure 13C:
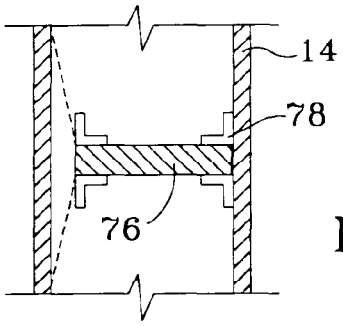
FIG. 13C is a side-sectional view of the barrel section shown in FIG. 13B taken along the section line in FIG. 13B.

Alternatively, as shown in FIGS. 13 and 13A, a stiffening element 76 may be supported away from the inner surface of the barrel 14 by cleats 78 or other suitable elements bonded or otherwise attached to the barrel wall. The cleats 78 axially capture the stiffening element 76 while allowing radial movement of the barrel 14 and the stiffening element 76. As shown in FIGS. 13B and 13C, upon impact with a ball, the barrel wall flexes inwardly until it contacts the stiffening element 76 and pushes it against the opposing barrel wall, which acts as a backstop.

Figure 14:
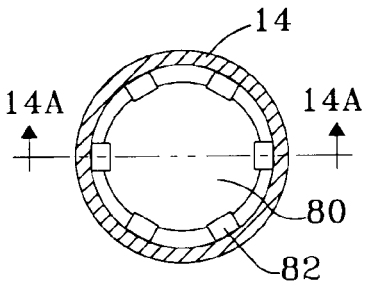
FIG. 14 is a top-sectional view of a bat barrel, before impact, including a stiffening element supported away from the inner surface of the barrel, according to another alternate embodiment.
Figure 14A:
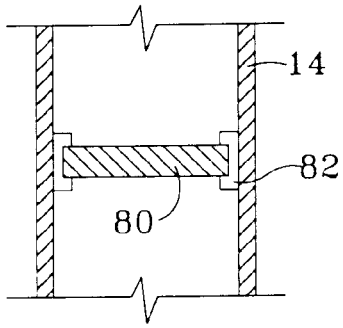
FIG. 14A is a side-sectional view of the barrel section shown in FIG. 14 taken along the section line in FIG. 14.
Figure 14B:
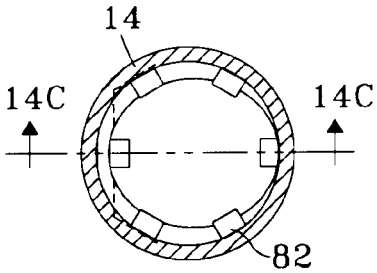
FIG. 14B is a top-sectional view of the bat barrel shown in FIG. 14, after impact.
Figure 14C:
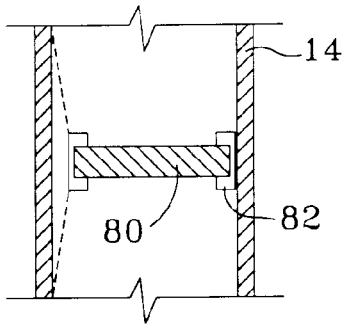
FIG. 14C is a side-sectional view of the barrel section shown in FIG. 14B taken along the section line in FIG. 14B.

As shown in FIGS. 14 and 14A, a stiffening element 80 may be supported away from the inner surface of the barrel 14 by a lightweight material such as an elastomeric adhesive 82, a urethane foam, or another suitable flexible material. As shown in FIGS. 14B and 14C, upon impact with a ball, the barrel wall flexes inwardly compressing or displacing the elastomeric adhesive 82 or other connecting material.

Figure 15A:
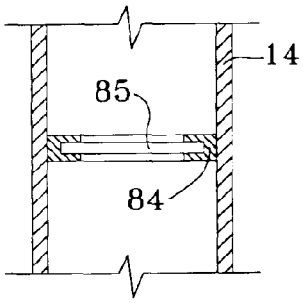
FIG. 15A is a side-sectional view of the barrel section shown in FIG. 15 taken along the section line in FIG. 15.
Figure 16A:
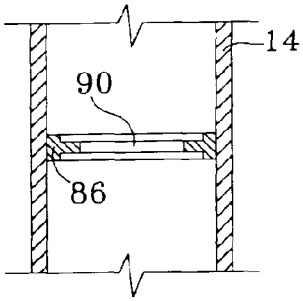
FIG. 16A is a side-sectional view of one embodiment of the barrel section shown in FIG. 16, including a T-shaped stiffening element, taken along the section line in FIG. 16.
Figure 16B:
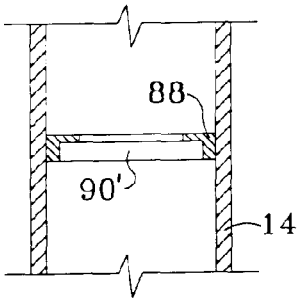
FIG. 16B is a side-sectional view of an alternate embodiment of the barrel section shown in FIG. 16, including an L-shaped stiffening element, taken along the section line in FIG. 16.
Figure 15:
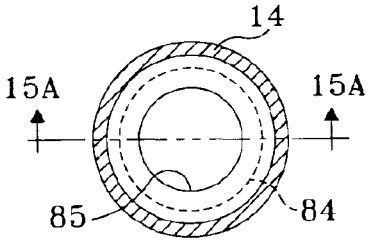
FIG. 15 is a top-sectional view of a bat barrel including a C-section stiffening element.
Figure 16:
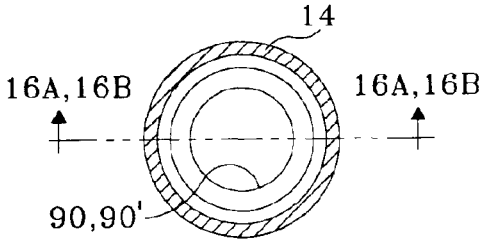
FIG. 16 is a top-sectional view of a bat barrel including a reinforcing section stiffening element.

FIGS. 15 and 15A illustrate a C-section stiffening element 84 connected along the inner circumference of the bat barrel 14. The C-section defines a hollow central opening 85. Similarly, FIG. 16A illustrates a T-section stiffening element 86, and FIG. 16B illustrates an L-section stiffening element 88, connected along the inner circumference of the bat barrel 14. Each of these sections also defines a hollow central opening 90/90'. Any of these stiffening elements may be co-molded into the barrel 14 in a composite ball bat, or may be bonded or otherwise affixed to the barrel 14 in a metal or composite ball bat.

Stiffening sections of this nature are preferably made of one or more high strength materials, such as one or more of the high strength metals or composite materials described above, since they generally include less material than the solid disks or slugs described above. As with all of the stiffening elements described herein, material selection may be dictated by the performance limits of a given regulatory association.

Figure 17A:
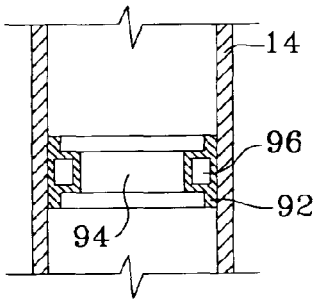
FIG. 17A is a side-sectional view of a bat barrel including a hollow "hat section" stiffening element.
Figure 17B:
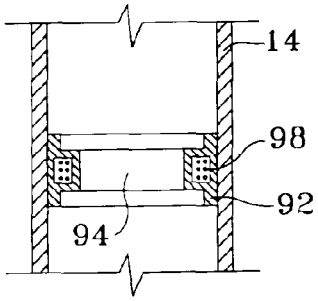
FIG. 17B is a side-sectional view of a bat barrel including a "hat section" stiffening element filled with a damping material.

FIG. 17A illustrates a "hat section" stiffening element 92 connected along the inner circumference of the bat barrel 14. Hat section elements 92 are known to be particularly effective at stiffening structures. The hat section 92 defines a hollow central opening 94 and optionally includes an opening 96 extending through the body of the hat section itself. In another embodiment, as shown in FIG. 17B, the opening through the hat section may be filled with a core material 98 to form a sandwich structure. The core material 98 may include urethane foam, thermoplastic urethane, balsa, extruded polystyrene foam (i.e., "Styrofoam®"), syntactic foam, or another suitable damping material. The optional core material 98 helps to dampen vibrations in the bat, which improves the feel of the bat upon impact with a ball. The optional core material 98 also aids in reducing BBCOR, as further described below.

The hat section element 92 may be formed from a cylindrical tube simply by changing the tube's outer diameter into a hat shape, or by depressing the outer surface of the tube, or by molding the tube with a constant outer diameter and varying the tube's inner diameter. In the case of varying the inner diameter, the hollow opening 96 may be molded using a bladder placed circumferentially between the outer and inner diameter surfaces. The hollow opening 96 could alternatively be molded using a rotational blow molding process, or using removable or dissolvable cores, such as polyvinyl alcohol or another suitable substance. Alternatively, the hat section 92 could result from the assembly of a first cylindrical section of tube and a second cylindrical section of tube having a smaller diameter and a depression formed in its outer diameter.

Another approach to governing barrel performance, which may be used alone or in combination with any of the stiffening elements described herein, involves damping the bat barrel 14. While adding stiffness is an effective manner of lowering a bat's BBCOR, the feel of a relatively stiff or rigid bat can sometimes be somewhat harsh, as vibrations resulting from off-center hits may result in a batter feeling "sting" in the batter's hands. Thus, many batters prefer that the barrel have some compliance, as such a barrel tends to provide improved feel during off-center hits away from the sweet spot.

Damping lowers the frequency of an object by adding mass to the object to slow its vibrational response. A damping material also wastes some energy when it is deformed, as it converts some of the energy of deformation into heat through internal hysteresis or friction. Adding damping materials to a bat barrel reduces the barrel's hoop frequency, which leads to a resultant reduction in the bat's BBCOR.

Damping materials can be added to a bat barrel 14 in multiple ways. One preferred embodiment involves adding damping material in a manner that limits the barrel's BBCOR without significantly increasing the bat's MOI by, for example, using a lightweight damping material or limiting the pivot radius of the material by locating it relatively close to the bat handle.

Figure 18A:
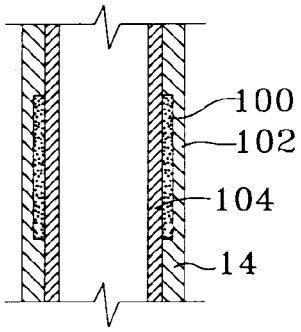
FIG. 18A is a side-sectional view of the barrel of the bat shown in FIG. 18.
Figure 18:
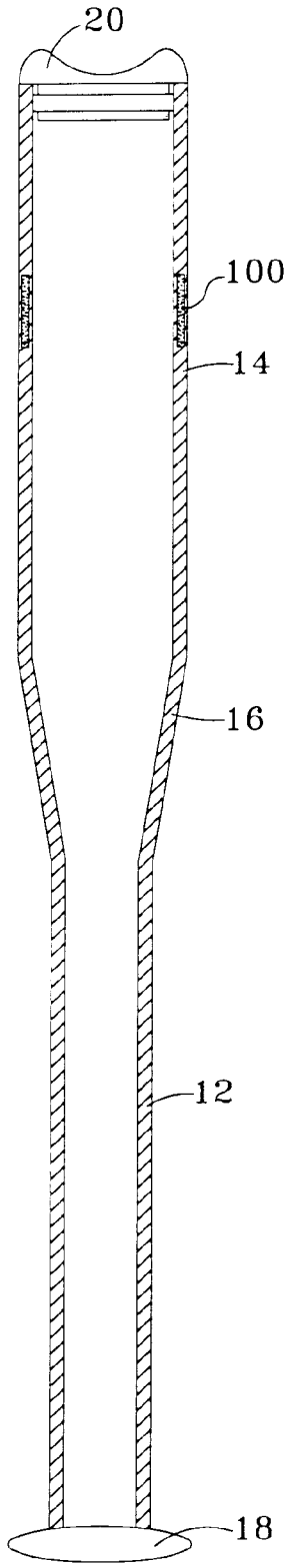
FIG. 18 is a side-sectional view of a ball bat including a damping, according to one embodiment.

As shown in FIGS. 18 and 18A, a damping element 100 may be positioned at or near the sweet spot of the barrel 14 between neighboring composite layers 102 and 104 in a composite ball bat (or between metal walls in a metal ball bat). The damping element 100 may be made of a compliant elastomeric material or another suitable damping material. Multiple damping elements 100 may optionally be placed at varying locations in the bat barrel 14.

Surprisingly, molding a very small amount of elastomeric material, for example, into a composite bat barrel provides a relatively dramatic reduction in the bat's BBCOR. It has been found, for example, that replacing a release ply acting as an ISCZ in a dual wall composite bat with a 6-inch wide, 0.008-inch thick thermoplastic urethane sheet caused an approximately 7.7% drop in the bat's BBCOR. It has further been found that adding three such thermoplastic urethane sheets (with a combined 0.024-inch thickness) merely increased the bat's MOI by approximately 180 $oz \cdot in^2$, while significantly lowering the bat's BBCOR. The use of a foam material could reduce the MOI effect of the material even further. If foam is used, it should be a type capable of maintaining its properties, shape, and strength through the temperatures and pressures involved in the composite molding process. Closed silicone foam, for example, could withstand the molding temperatures and pressures.

A variety of materials that could be used to create a damping element 100 include elastomeric materials, thermoplastic urethane, neoprene, Santoprene®, nitrile-butadiene rubber, styrene-butadiene rubber, urethane foam, flexible adhesives such as urethane adhesive (DP620), or any other suitable damping materials. The use of foam materials, in particular, tends to increase the damping coefficient of the material (i.e., provides more energy waste) while limiting the weight of the material. In one embodiment, an air bladder with a relief valve, such as a piece of foam positioned between two plastic sheets, could be used as a damper to effectively lower the rebound speed of the bat barrel. The use of any of these damping materials reduces BBCOR and also reduces vibrations and the resultant sting, thus improving the bat's feel.

Figure 19:
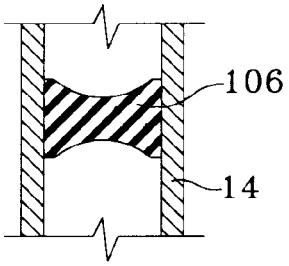
FIG. 19 is a side-sectional view of a bat barrel including an alternate damping element.

FIG. 19 illustrates a substantially solid damping element 106 bonded to the inside diameter of the bat barrel 14. A relatively rigid damping material should be used in this embodiment, since damping is achieved primarily via the mass and stiffness of the damping material itself (as opposed to the damping being enhanced by the mass and stiffness of neighboring barrel walls, as is the case in the above embodiment). Rubber having a 40 A durometer or higher, for example, could be used to construct the damping element 106. Foam materials could also be used but would dampen performance to a lesser extent due to their generally lighter density, as compared to a completely solid material.

Figure 20:
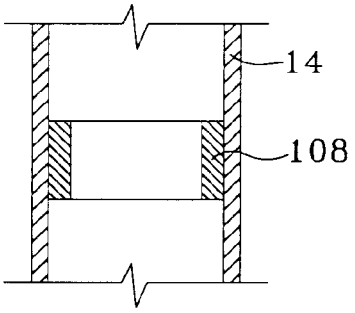
FIG. 20 is a side-sectional view of a bat barrel including another alternate damping element.

FIG. 20 illustrates a damping element 108 in intimate contact, but not bonded to, the inside diameter of the bat barrel 14. With increased rigidity, modulus, or interference fit, a damping material can provide adequate damping without being bonded to the bat barrel 14. The stiffness of the material would need to be sufficient to keep the material in contact with the barrel wall as the wall rebounds to its original shape after impact. The damping coefficient of the material will dictate the material's effectiveness in limiting the barrel's energy return to the ball. The durometer of the material should be significantly higher than that of a bonded material to achieve equal damping. An elastomer having a durometer of approximately 50 D or greater could effectively be used.

In the embodiments described herein, the stiffening elements or damping elements are generally described as being located at or near the sweet spot of the barrel 14. In some embodiments, it may be desirable to locate the stiffening elements or damping elements closer to the handle 12 to reduce the effect on the bat's MOI. Since the MOI is related to the square of the pivot distance, moving any added weight closer to the hands considerably lowers the bat's MOI. While doing so may necessitate an "over-reduction" in BBCOR at the location of the stiffening or damping element (since the sweet spot will still need to be brought within association performance limits, and a lesser reduction in BBCOR generally occurs at locations spaced from the stiffening or damping element), the tradeoff in substantially reduced MOI may be preferred for certain bats or batters.

In some embodiments, one or more damping elements may be used in conjunction with one or more stiffening elements to reduce the bats' BBCOR without appreciably increasing its MOI. The one or more damping elements will enhance the batter's feel and reduce sting while also reducing the bat's BBCOR, and the stiffening element will further reduce the bat's BBCOR and increase its durability.

In a composite bat, for example, a 2-inch wide, 0.006-inch thick layer of foamed thermoplastic urethane may be located approximately at the barrel's radially mid-laminate region, while a stiffening disk or slug may be bonded or otherwise affixed to the inner surface of the barrel. Alternatively, the stiffening element may be omitted and the composite barrel itself may have a stiff design, such as a laminate with mostly carbon fibers angled at greater than 35 degrees, preferably at approximately 60 degrees, relative to the longitudinal axis of the ball bat. Such a design has been found to reduce the bat barrel's BBCOR below 0.500. Indeed, in a composite bat having a laminate with carbon fibers angled at 60 degrees and a single 0.006-inch thick layer of foamed thermoplastic urethane located approximately at the barrel's radially mid-laminate region, the BBCOR was found to be approximately 0.472 (most existing bats designed for competitive play, by comparison, generally have BBCOR's greater than 0.530).

In an aluminum bat, a stiffening slug or "spoked wheel," for example, may be bonded or otherwise affixed to an inner surface of the barrel using a foamed thermoplastic urethane or a flexible elastomeric adhesive. Any other suitable combination of damping and stiffening elements may alternatively be utilized to meet the requirements of a given regulatory association or batter.

The stiffening elements and damping elements described herein may be co-molded with the inner surface of a composite bat barrel, or may be adhesively bonded, welded, or otherwise affixed to the inner surface of a composite or metallic bat barrel. In some embodiments, the stiffening elements and damping elements may alternatively be held in place in the barrel via an interference fit. As described above, damping elements may additionally or alternatively be positioned between composite layers or metal walls in a ball bat. While the dimensions and weight of the stiffening elements and damping elements may vary greatly depending on the requirements of a particular regulatory association or batter, it is generally preferred that they weigh less than one ounce so as to minimize the effect on the bat's MOI. In some applications, however, heavier stiffening or damping elements may be used.

Any of the above-described embodiments may be used alone or in combination with one another. Furthermore, the ball bats may include additional features not described herein. While several embodiments have been shown and described, various changes and substitutions may of course be made, without departing from the spirit and scope of the invention. The invention, therefore, should not be limited, except by the following claims and their equivalents.

What is claimed is:

1. A ball bat, comprising:

a barrel including a sweet spot;

a handle attached to or continuous with the barrel; and a stiffening element, comprising:

a substantially cylindrical first portion positioned along an inner circumference of the barrel; and a second portion projecting radially inwardly from the first portion and positioned between the sweet spot and the handle, and closer to the sweet spot than to the handle, wherein the stiffening element includes a radially central opening.

2. The ball bat of claim 1 wherein the first portion of the stiffening element is affixed to the inner circumference of the barrel.

3. The ball bat of claim 2 wherein the stiffening element is affixed to the inner circumference of the barrel via an adhesive comprising one of a foamed thermoplastic urethane and a flexible elastomeric adhesive.

4. The ball bat of claim 1 wherein the stiffening element is made of a different material than the barrel.

5. The ball bat of claim 1 wherein the stiffening element is made of a metal material.

6. The ball bat of claim 1 wherein the stiffening element is made of a fiber-reinforced composite material.

7. The ball bat of claim 1 wherein the stiffening element further comprises an internal opening.

8. The ball bat of claim 7 wherein the internal opening is isolated from the hollow region of the barrel.

9. The ball bat of claim 7 wherein the internal opening is filled with a foam material.

10. A ball bat, comprising:

a substantially hollow barrel having an inner surface and a sweet spot;

a handle attached to or continuous with the barrel; and a stiffening element that is generally T-shaped in cross section positioned along an inner circumference of the barrel between the sweet spot and the handle, and closer to the sweet spot than to the handle, wherein the stiffening element includes an internal opening.

11. The ball bat of claim 10 wherein the internal opening is isolated from the hollow region of the barrel.

12. The ball bat of claim 10 wherein the internal opening is filled with a foam material.

13. The ball bat of claim 10 wherein the stiffening element is made of a different material than the barrel.

14. The ball bat of claim 10 wherein the stiffening element is made of a metal material.

15. The ball bat of claim 10 wherein the stiffening element is made of a fiber-reinforced composite material.

16. A ball bat, comprising:

a barrel including a sweet spot;

a handle attached to or continuous with the barrel; and a stiffening element, comprising:

a substantially cylindrical first portion positioned along an inner circumference of the barrel; and a second portion projecting radially inwardly from the first portion and positioned adjacent to the sweet spot between the sweet spot and the handle, wherein the stiffening element includes a radially central opening.

17. The ball bat of claim 16 wherein the stiffening element is made of a different material than the barrel.

18. The ball bat of claim 16 wherein the stiffening element is made of a fiber-reinforced composite material.

* * * * *